United States Patent [19]

Kelley et al.

[11] 4,255,736

[45] * Mar. 10, 1981

[54] THERMAL PROTECTIVE SWITCH

[76] Inventors: John R. Kelley; Harold G. Wyse, both of 3629 N. Dixie Dr., Dayton, Ohio 45414

[ * ] Notice: The portion of the term of this patent subsequent to Jan. 16, 1996, has been disclaimed.

[21] Appl. No.: 3,256

[22] Filed: Jan. 15, 1979

Related U.S. Application Data

[63] Continuation-in-part of Ser. No. 792,530, May 2, 1977, Pat. No. 4,135,177.

[51] Int. Cl.[3] ..... H01H 37/60; H01H 37/76

[52] U.S. Cl. ..... 337/407; 337/414

[58] Field of Search ..... 337/401, 402, 407-416

[56] References Cited

U.S. PATENT DOCUMENTS

| | | | |
|---|---|---|---|
| 412,845 | 10/1889 | Ely | 337/407 |
| 2,955,179 | 10/1960 | Milton et al. | 337/416 |
| 3,301,981 | 1/1967 | Urani | 337/414 |
| 3,827,014 | 7/1974 | Wehl | 337/414 |
| 3,952,274 | 4/1976 | Plasko | 337/408 |
| 4,135,177 | 1/1979 | Kelley et al. | 337/408 |
| 4,145,654 | 3/1979 | Grimm | 337/407 |

*Primary Examiner*—William H. Beha, Jr.

*Attorney, Agent, or Firm*—Jacox & Meckstroth

[57] ABSTRACT

A thermally sensitive switch is provided with two parallel lead wires or conductive members which are confined within a two section insulated housing. Electrical continuity between members is established by a conductive contact element which bridges the two conductive members to provide a continuous electrical path. The contact element is held in place by a temperature sensitive material which changes state at a predetermined temperature and by a spring element which exerts a force on the pellet through the contact element. When the temperature sensitive material changes state, the spring force drives the contact between the conductive members to effect a snap-action instantaneous interruption of the electrical circuit. The construction and assembly of the components provide for minimizing the production cost of the switch.

18 Claims, 8 Drawing Figures

THERMAL PROTECTIVE SWITCH

RELATED APPLICATION

This application is a continuation-in-part of application Ser. No. 792,530, filed May 2, 1977, now U.S. Pat. No. 4,135,177.

BACKGROUND OF THE INVENTION

Temperature sensitive or responsive switches, often referred to as "One-Shot" thermal cut-offs, are well known in the art, for example, as disclosed in U.S. Pat. Nos. 3,291,945, 3,820,050, 3,944,960 and 4,001,754. However, recent consumer safety trends have increased the need for a more reliable, easily manufactured thermal cut-off switch for use on electrical components and appliances. The majority of thermal cutoff switches presently being commercially used are complex in design and difficult to fabricate. In addition, most of the switches are constructed with an electrically conductive housing that is part of the electrical path and therefore requires an electrical insulator at the time of application. The circuit interruption of these switches is accomplished by a "slow-break," sometimes called a "creep-action." Accordingly, there is a need for a thermal cut-off switch which can be easily and inexpensively produced with an insulated housing, fewer moving parts, and a fast-break or snap-action circuit interruption.

SUMMARY OF THE INVENTION

In accordance with the present invention, a temperature sensitive switch is designed to provide a "snap-action" circuit interruption at a predetermined temperature. This is achieved by the change of state of a temperature sensitive material which permits a spring loaded contact element to separate irreversibly and interrupt a previously continuous electrical current path. Thus the device offers highly reliable circuit interruption with fewer parts and is adapted to be manufactured at lower costs.

The above features and advantages are provided in one embodiment of the invention by using an electrically insulated two section housing which encloses a spring loaded leaf type contact element which forms a current path between two parallel spaced conductive members or lead wires. A temperature sensitive material and a spring element position the contact element, and the spring element provides the force necessary to activate the device. The housing is molded of an electrically non-conductive material and consists of mating top and bottom section having means for positioning the internal components precisely in place.

The temperature sensitive material provides a base for supporting the contact element to provide continuity from one conductive member to another through the contact element. The force of the spring element provides the pressure to insure reliable contact pressure for circuit continuity. At a predetermined temperature, the temperature sensitive material changes state, permitting the element to force the contact element between the parallel spaced conductive members to interrupt the electrical circuit.

Other features and advantages of the invention will be apparent from the following description, the accompanying drawing and the appended claims.

DESCRIPTION OF THE PREFERRED EMBODIMENTS

Figure 1:
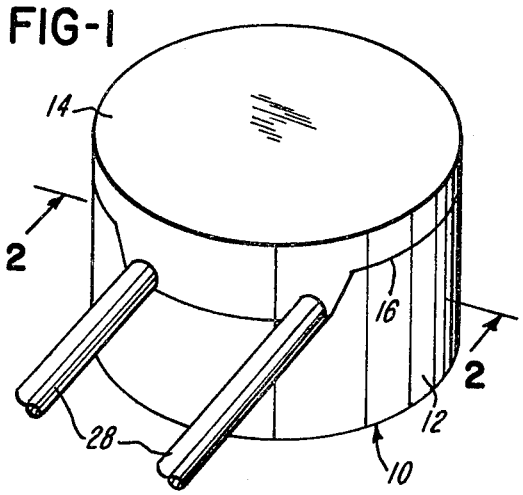
FIG. 1 is a substantially enlarged perspective view of a thermally sensitive switch constructed in accordance with the present invention.

For purpose of illustration, the thermal sensitive or protective switch shown in the drawing is substantially enlarged from its actual size which is approximately 5/16 inch in diameter. The switch includes a housing 10 formed by a bottom section 12 and a mating top section 14 each having a cylindrical outer surface. The housing sections 12 and 14 are formed of an electrically insulating material such as a thermoplastic or ceramic and are secured together by adhesive or ultrasonic welding at the abutting peripheral surfaces forming the joint 16. The bottom housing section 12 defines a cylindrical chamber or cavity 18 which extends to form a relatively thin bottom wall 19. A cylindrical body or pellet 22 of temperature sensitive material is confined within the cavity 18. The material is electrically nonconductive and is normally rigid or solid until exposed to a predetermined melting temperature for example, a temperature within the range of 130° F. to 800° F. The formulation of the material forming the pellet 22 is well known in the art and is disclosed in issued patents as well as published technical references.

Figure 4:
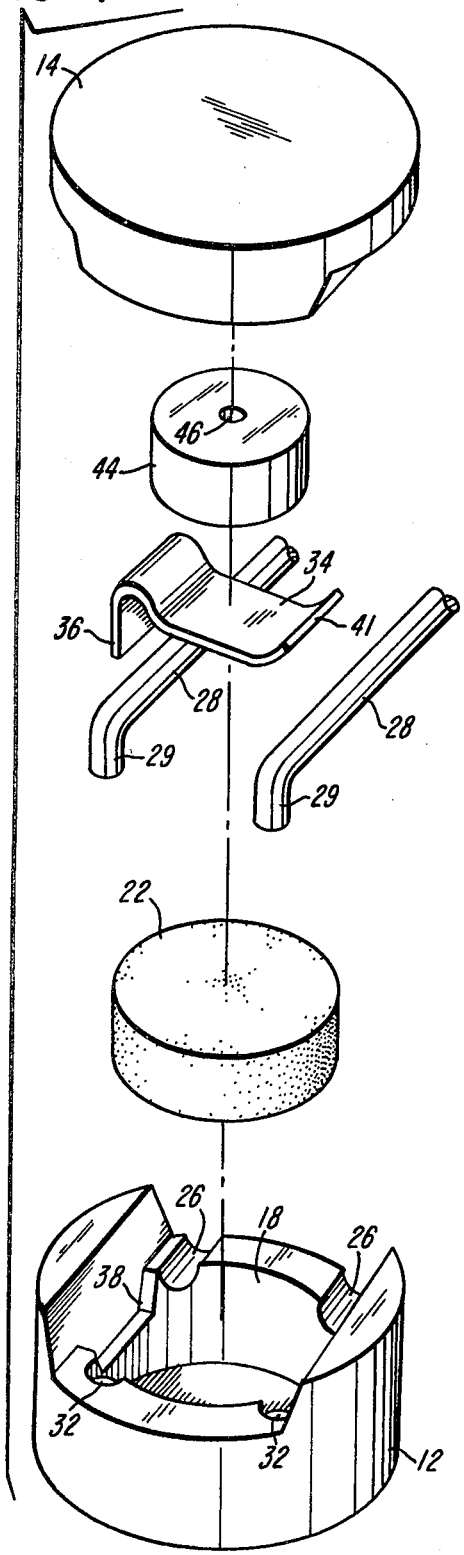
FIG. 4 is an exploded perspective view of the components of the thermally sensitive switch shown in FIGS. 1–3.

The bottom housing section 12 and the top housing section 14 cooperate to define a pair of parallel spaced cylindrical bores 26 (FIG. 4) which receive a corresponding pair of parallel spaced electrically conducting wires or conductors 28 such as copper wires. The conductors 28 have L-shaped inner end portions 29 which project downwardly and socket into corresponding blind holes 32 formed within the bottom housing section 12. The interfitting of the conductor end portions 29 into the socket holes 32 is effective to prevent twisting of the conductors 28 as well as prevent the conductors from being pulled axially after the conductors are sandwiched between the housing sections 12 and 14 within the bores 26.

Figure 2:
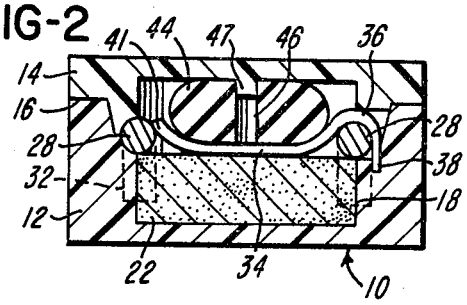
FIG. 2 is a section taken generally along the line 2—2 of FIG. 1 and showing the thermally sensitive switch in a position forming a continuous electrical circuit.

A leaf-type metal contact element 34 extends between the conductors 28 within the housing 10 and normally rests on the upper surface of the solid temperature sensing pellet 22, as shown in FIG. 2. The contact element 34 is formed from a thin sheet metal strip having a slight spring characteristic such as copper or silver cadmium oxide and has one end portion 36 with a hook-like configuration which seats on one of the conductors 28. The end portion 36 projects downwardly into a locating slot 38 (FIG. 2) formed within the bottom housing section 12. The opposite end portion 41 of the contact element 34 curves upwardly and normally seats on the opposite conductor 28, as also shown in FIG. 2.

The contact element 34 is urged into firm engagement with the conductors 28 by a spring element 44 to insure a positive electrical connection between the conductors 28 within the housing 10. The spring element 44 is formed of an annular body of resilient material such as silicone rubber which has excellent temperature and spring characteristic as well as a high coefficient of expansion. The spring element 44 has a center hole 46 which receives a center locating stud 47 (FIG. 2) formed as an integral part of the top housing section 14. The stud 47 positions the spring element 44 centrally within the housing 10 and directly over the contact element 34 so that the contact element is normally held in positive contact with the conductors 28 and the pellet 22 of temperature sensitive material.

Figure 3:
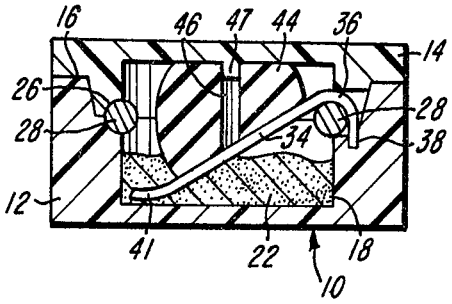
FIG. 3 is a section similar to FIG. 2 and showing the thermally sensitive switch after it has been actuated to interrupt the circuit.

In the operation of the thermal protective switch, when the pellet 22 senses a predetermined temperature by heat transfer through the bottom wall 19 of the housing 10, the pellet melts into a flowable state. The downward force exerted by the spring element 44 causes the contact element 34 to pivot downwardly as illustrated in FIG. 3. As the end portion 41 of the contact element 34 passes through a plane defined by the axes of the parallel wire conductors 28, the over-center condition produces a snap-action effect causing the end portion 41 to spring downwardly from the one conductor 28 thereby immediately interrupting the circuit. The expansion of the resilient spring element 44 forces the contact element 34 downwardly into the melted body 22 of temperature sensitive material.

Referring to FIGS. 5–8 which illustrates another embodiment of a thermal protective switch constructed in accordance with the invention, a housing 50 is injection molded of a plastics material and includes a tubular or hollow base section 52 and a flat top cover section 54. The housing section 52 defines a cylindrical cavity 56 which extends from the bottom of the housing section to an internal radial shoulder 57 which extends radially from diametrically opposed part-cylindrical surfaces 59. The housing section 52 also includes a pair of diametrically opposed part-cylindrical projections 62, and a narrow rectangular slot 63 extends downwardly or axially within the inner surface of each projection 62 and has a blind end below the shoulder 57. The projections 62 also define therebetween a pair of diametrically opposed notches or recesses 66 (FIG. 8) which extend from the corresponding part-cylindrical surfaces 59.

The cover section 54 of the housing 50 is constructed to fit within the recesses 66 and includes a reduced portion 68 (FIG. 6) which projects downwardly between the diametrically opposed surfaces 59 so that the cover section 54 seats within the base section 52. A thin conductor 70 extends inwardly into one of the recesses or slots 63 and is preferably formed from a thin strip of sheet metal such as berylium copper. The conductor 70 includes an inner folded or V-shaped portion 71 which is wedged into the lower portion of the corresponding slot 63 so that the conductor is positively located and retained within a fixed position. A contact element 72 is formed as an integral part of the conductor 70 and extends from the V-shaped portion 71 diametrically across the cavity 56 along a reference plane P. The contact element 72 projects upwardly to form a flat contact surface 73 above the plane P. The metal strip forming the conductor 70 and contact element 72 continues from the contact surface 73 in a return direction to form an integral spring portion or element 74.

Figure 5:
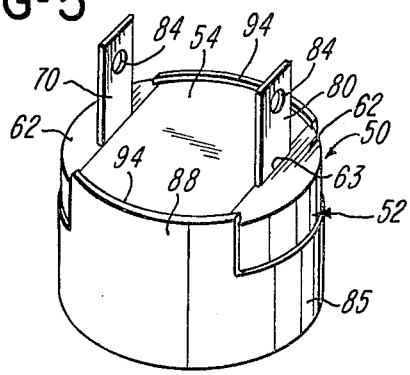
FIG. 5 is a perspective view similar to FIG. 1 and showing a second embodiment of the invention.
Figure 8:
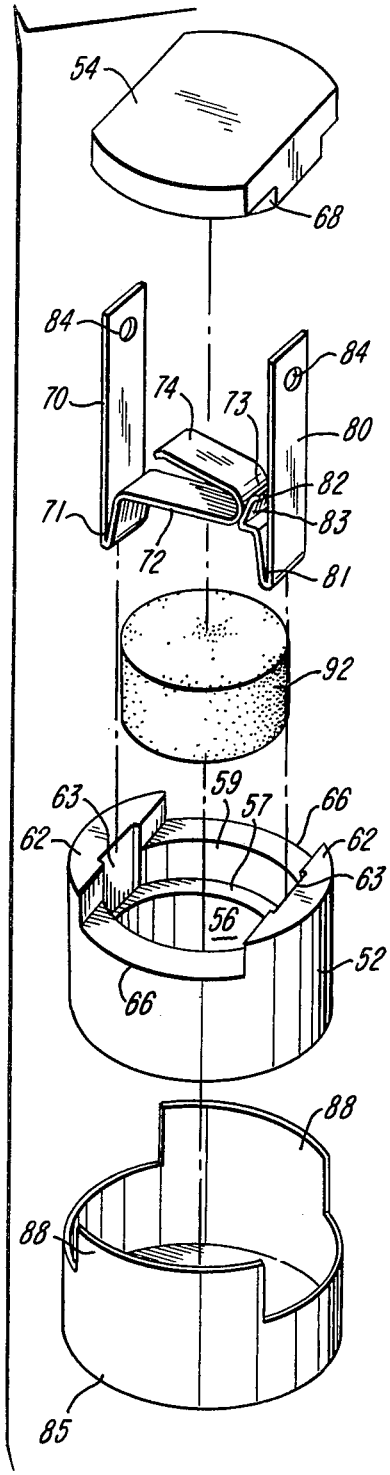
FIG. 8 is an exploded perspective view similar to FIG. 4 of the second embodiment.

Another sheet metal conductor 80 is also formed from a thin strip of metal such as berylium copper and extends inwardly into the other slot 63 parallel to the conductor 70. The conductor 80 also includes a folded or V-shaped inner end portion 81 which is wedged into the inner portion of the slot 63 to position and retain the conductor 80 within the housing section 52. A V-shaped contact portion 83 is formed as an integral part of the metal strip which forms the conductor 80 and has a small flat contact surface 83 which normally engages the flat surface 73 of the contact element 72. As shown in FIGS. 5 and 8, both of the conductors 70 and 80 have holes 84 within their outer end portions, and the holes 86 are adapted to receive lead wires which may be soldered or crimped to the conductors. The conductors 70 and 80 may also be formed as male spade-like terminals for receiving quick connect mating female terminals.

Figure 6:
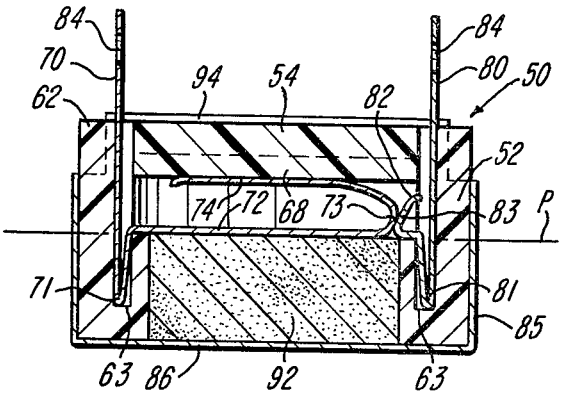
FIG. 6 is a section similar to FIG. 2 of the second embodiment.

In the assembly of the thermal switch as illustrated in FIG. 5–8, the housing section 52 is placed within a cylindrical cup-shaped metal can or shell 85 which has a flat circular bottom wall 86 and a pair of upwardly projecting and diametrically opposed ear or flange portions 88. As mentioned above, the outer diameter of the metal shell 85 is much smaller than illustrated, for example, on the order of 5/16 inch. A cylindrical pellet 92 is constructed of a thermal sensing material as mentioned above in connection with the pellet 22, and the bottom surface of the pellet 92 seats on the bottom surface 86 of the metal shell 85. The upper surface of the pellet 92 is flush with the internal shoulder 57 so that when the conductor 70 is inserted into its corresponding slot 63, the upper surface of the pellet 92 forms a support for the contact portion or element 72, as shown in FIG. 6.

After the conductor 80 is inserted within its slot 63 and the conductor 70 is inserted into its slot 63, the cover section 54 of the housing 50 is positioned within the recesses 66 so that the inner portion 68 of the cover section presses downwardly on the spring element 74 to produce a firm contact between the contact surfaces 73 and 83. While the cover section 54 is held in place, the flange portions 88 of the sheet metal shell 85 are bent to form inwardly projecting lips 94 which overlie and positively retain the cover section 54. If desired, a sealant material may be placed between the housing sections 52 and 54 before the sections are assembled to form a hermetically sealed switch unit or assembly.

Figure 7:
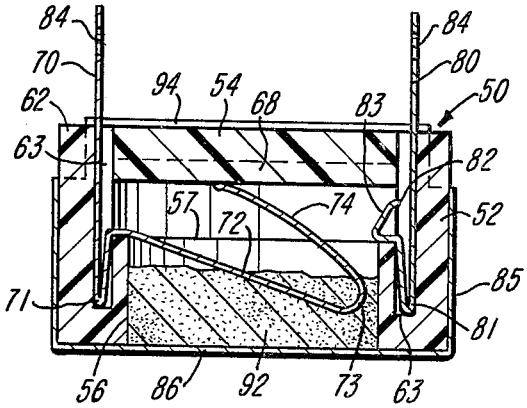
FIG. 7 is a section similar to FIG. 3 of the second embodiment.

The thermal switch shown in FIGS. 5–8 operates in substantially the same manner as the thermal switch described above in connection with FIGS. 1–4. That is, when the metal bottom wall 86 of the shell 85 senses a temperature sufficiently high to melt the pellet 92, the force exerted by the spring element 74 is sufficient to cause the contact surface 73 on the contact element 72 to spring past the contact surface 83 on the contact portion 82. As a result, the contact element 72 moves in a snap action manner to its interrupted or open position as shown in FIG. 7. Thus the contact element 72 springs through the reference plane P to produce the snap action movement of the contact element from its conducting position to its interrupted or open position.

It is apparent from the drawings and the above description that a thermal sensitive or protective switch constructed in accordance with the present invention, provides desirable features and advantages. For example, the switch is simple in construction and incorporates fewer components than normally required in commercially used thermal protective switches. In addition, the components are relatively inexpensive components, and the insulated case or housing 10 or 50 is desirable for many installations. The thermal protective switch of the invention also provides for snap actuation which is highly desirable to insure immediate or instantaneous interruption of the circuit and to prevent the possibility of arcing which can weld metal components together and maintain a short circuit. It is also apparent that the thermal protective switch described above may be used as a current sensing switch simply by selecting the material for the conductors and/or contact element with a predetermined resistance.

The embodiment shown in FIGS. 5–8 further provides for minimizing the number of parts or components over the embodiment shown in FIGS. 1–4 and has fewer critical tolerances so that labor costs are reduced along with material costs. The embodiment of FIGS. 5–8 is also adapted for more automated assembly in order to reduce its construction costs, and may be easily and quickly assembled into an appliance or other device which requires thermal protection.

While the forms of protective switch herein described constitute preferred embodiments of the invention, it is to be understood that the invention is not limited to these precise forms of switch, and that changes may be made therein without departing from the scope and spirit of the invention as defined in the appended claims.

The invention having thus been described, the following is claimed:

1. A thermal switch comprising a housing, a set of elongated first and second conductors having corresponding inner portions disposed within said housing, a contact element disposed within said housing and connected to said inner portion of said first conductor, said contact element extending towards said inner portion of said second conductor and having a contact portion engaging a contact surface of said inner portion of said second conductor at a location spaced on one side of a reference plane when said contact element is in a conducting position, said inner portion of said second conductor projecting from said contact surface towards said inner portion of said first conductor to form a restriction to the movement of said contact element at said reference plane, a thermal sensing element disposed within said housing for normally retaining said contact element in said conducting position, said thermal sensing element being capable of changing from a rigid state to a melted state in response to being heated to a predetermined temperature, spring means associated with said contact element for urging said contact element from said conducting position to an interrupted position on the other side of said reference plane in response to changing of said thermal sensing element to said melted state, and said contact element passes transversely through said reference plane when moving from said conducting position to said interrupted position to effect snap-action movement of said contact element.

2. A thermal switch as defined in claim 1 wherein said spring means comprises a spring element integrally connected to said contact element, and said conductors are disposed generally in parallel spaced relation within said housing.

3. A thermal switch as defined in claim 1 wherein said first conductor and said contact element comprise a thin strip of sheet metal having a substantially uniform thickness, and said spring means comprise an integral reverse folded extension of said contact element and forming a leaf-like spring.

4. A thermal switch as defined in claim 1 wherein said housing is substantially cylindrical and defines a cavity receiving said thermal sensing element, a cup-shaped sheet metal shell receiving said housing and having a bottom wall supporting said thermal sensing element within said cavity, and means for securing said shell to said housing.

5. A thermal switch as defined in claim 1 wherein each of said conductors comprises a thin flexible flat metal strip, and said contact element is integrally connected to said first conductor and forms an extension of said strip.

6. A thermal switch as defined in claim 5 wherein said spring means comprises a leaf-like spring forming a further extension of said strip, and said contact element forms an integral connection of said spring to said first conductor.

7. A thermal switch as defined in claim 1 wherein said housing is cylindrical and includes diametrically opposite projections each cooperating to define a slot for one of said conductors, and a cover member seated between said projections and cooperating to retain said conductors.

8. A thermal switch as defined in claim 1 wherein said housing defines parallel spaced narrow slots, and each of said conductors comprises a thin metal strip having a V-shaped said inner portion projecting into the corresponding said slot.

9. A thermal switch as defined in claim 8 wherein said strip forming one of said conductors extends to form said contact element.

10. A thermal switch as defined in claim 9 wherein said strip extends further from said contact element in a reverse direction to form said spring means.

11. A thermal switch as defined in claim 1 wherein said housing comprises a tubular base section and a cover section, a metal cup-shaped shell receiving said base and cover sections, and said shell includes at least one flange portion projecting inwardly over said cover section.

12. A thermal switch as defined in claim 11 wherein said cover section includes a portion projecting into said base section and engaging said spring means.

13. A thermal switch comprising a housing, a set of elongated first and second sheet metal conductors having corresponding inner portions disposed within said housing, a sheet metal contact element integrally connected to said inner portion of said first conductor and forming an extension thereof, said contact element extending towards said inner portion of said second conductor and having a contact portion engaging a contact surface of said inner portion of said second conductor at a location spaced on one side of a reference plane when said contact element is in a conducting position, said inner portion of said second conductor projecting from said contact surface towards said inner portion of said first conductor to form a restriction to the movement of said contact element at said reference plane, a thermal sensing element disposed within said housing for normally retaining said contact element in said conducting position, said thermal sensing element being capable of changing from a rigid state to a melted state in response to being heated to a predetermined temperature, a sheet metal spring element integrally connected to said contact element and extending therefrom for urging said contact element from said conducting position to an interrupted position on the other side of said reference plane in response to changing of said thermal sensing element to said melted state, and said contact element passes transversely though said reference plane and said restriction when moving from said conducting position to said interrupted position to effect snap-action movement of said contact element.

14. A thermal switch as defined in claim 13 wherein said spring element extends in a revsere direction from said contact element.

15. A thermal switch as defined in claim 13 wherein said housing is substantially cylindrical and defines a cavity receiving said thermal sensing element, a cup-shaped sheet metal shell receiving said housing and having a bottom wall supporting said thermal sensing element within said cavity, and means for securing said shell to said housing.

16. A thermal switch as defined in claim 13 wherein said housing includes diametrically opposite projections each cooperating to define a narrow slot for one of said conductors, and a cover member seated between said projections and cooperating to retain said conductors within said housing.

17. A thermal switch as defined in claim 13 wherein said housing defines parallel spaced narrow slots, and each of said conductors has a V-shaped said inner portion projecting into the corresponding said slot.

18. A thermal switch as defined in claim 13 wherein said housing comprises a tubular base section and a sheet cover section, a metal cup-shaped shell receiving said base and cover sections, and said shell includes at least one flange portion projecting inwardly over said cover section.

* * * * *

UNITED STATES PATENT AND TRADEMARK OFFICE

CERTIFICATE OF CORRECTION

PATENT NO. : 4,255,736

DATED : March 10, 1981

INVENTOR(S) : John R. Kelley et al.

It is certified that error appears in the above—identified patent and that said Letters Patent is hereby corrected as shown below:

Column 7, Claim 13, line 8, "though" should read -- through --.

Column 8, Claim 18, line 15, cancel "sheet"; same line 15, after "a" insert -- sheet --.

Signed and Sealed this

Ninth Day of June 1981

[SEAL]

Attest:

RENE D. TEGTMEYER

Attesting Officer

Acting Commissioner of Patents and Trademarks